United States Patent [19]

Argon

[11] Patent Number: 4,858,514

[45] Date of Patent: Aug. 22, 1989

[54] MOUNTING ASSEMBLY FOR A SADDLE FRAME STRUCTURE HAVING A CRADLE FOR A GUN BARREL

[75] Inventor: Gideon Argon, Tel-Aviv, Israel

[73] Assignee: Salgad International Ltd., Cayman Insel (Jamaika), Cayman Islands

[21] Appl. No.: 33,579

[22] Filed: Apr. 1, 1987

[30] Foreign Application Priority Data

Apr. 10, 1986 [DE] Fed. Rep. of Germany ..... 3612018
Sep. 13, 1986 [DE] Fed. Rep. of Germany ..... 3631206

[51] Int. Cl.[4] ..... F41F 21/02
[52] U.S. Cl. ..... 89/37.05; 89/41.01
[58] Field of Search ..... 89/37.05, 37.02, 37.17, 89/40.03, 40.08, 36.13, 37.16, 41.01, 41.02

[56] References Cited

U.S. PATENT DOCUMENTS

| | | | |
|---|---|---|---|
| 953,139 | 3/1910 | Hall | 89/41.02 |
| 1,080,490 | 12/1913 | Silveira | 89/36.13 |
| 1,173,215 | 2/1916 | Rausenberger | 89/40.08 |
| 1,185,326 | 5/1916 | Humphreys | 89/41.02 |
| 1,613,822 | 1/1927 | Goetzenberger | 89/41.01 |
| 1,700,384 | 1/1929 | Stachnyk | 89/40.03 |
| 2,382,110 | 8/1945 | Sheldrick et al. | 89/41.01 |
| 2,484,869 | 10/1949 | Zeidler | 89/37.16 |
| 2,486,526 | 11/1949 | Gross | 89/41.02 |
| 2,586,990 | 2/1952 | Poitras et al. | 89/41.01 |
| 2,712,271 | 7/1955 | Wabnitz | 89/36.13 |
| 4,579,036 | 4/1986 | LeBlanc | 89/41.12 |
| 4,714,004 | 12/1987 | Weinfurth | 89/37.09 |

FOREIGN PATENT DOCUMENTS

| | | | |
|---|---|---|---|
| 31448 | 3/1927 | France | 89/37.05 |

*Primary Examiner*—Deborah L. Kyle
*Assistant Examiner*—Stephen Johnson
*Attorney, Agent, or Firm*—Neil F. Markva

[57] ABSTRACT

The assembly comprises a bottom plate mounted to freely rotate with respect to a stationary base plate and carrying the saddle frame structure for a gun barrel. A gear unit includes drivable gear mechanism for drivingly rotating the bottom plate with respect to the stationary base plate. A coupling mechanism includes a device for operatively engaging the drivable gear mechanism to rotate the bottom plate member with respect to the stationary base plate. The coupling mechanism includes a gear engaging mechanism movable between a disengaged position in which the drivable gear mechanism is not operatively engaged so that the bottom plate is in a freely rotatable condition and an engaged position in which the gear mechanism is effecitve to rotate the bottom plate with respect to the stationary base plate. In the disengaged position, free rotation of the bottom plate with respect to the stationary base plate may be made in a simple and quick manner via an actuating device.

11 Claims, 5 Drawing Sheets

9
64
22
10
24
65
61
63
62
23

MOUNTING ASSEMBLY FOR A SADDLE FRAME STRUCTURE HAVING A CRADLE FOR A GUN BARREL

FIELD OF THE INVENTION

The invention relates to a mounting assembly for a saddle frame structure having a cradle means for receiving a gun barrel. More particularly, the invention is directed to a mounting assembly for a projector tube of a grenade or fin-stabilized projectile launcher wherein the saddle frame structure has a bottom plate rotatably mounted to a stationary base plate and includes a gear unit for rotating the bottom plate.

BACKGROUND OF THE INVENTION

Known grenade projectors usually employ a projector or launcher tube having a closed lower end and an open upper end into which the grenade is inserted from above into the projector tube. The grenade slides downwardly into the projector tube and strikes the firing mechanism accommodated in the closed sealing cap.

Upon striking the firing mechanism, the propelling charge is detonated on the tail of the fin-stabilized missle or grenade. Thus, the fin-stabilized projectile is fired out of the projector tube which preferably has a smooth inner wall.

The sealing cap of the projector tube has a bottom piece generally spherically shaped and in an articulated engagement with a bottom plate resting on a supporting surface such as the ground or the like. The oblique position of the projector tube is determined by its relationship to the frame support, the length and the height of which frame support may be varied.

Greater caliber gun barrels are generally not transportable but are fixedly mounted such as in fortification guns, ship's guns, railway guns and the like. In these instances, it is known to mount a gun barrel in a cradle of a saddle frame rotatably mounted with respect to a base plate mechanism. A motorized gear unit is used to rotate the saddle frame structure with respect to the stationary base plate.

In known mounting assembly, the gun barrel may be laterally adjusted and all the parts of the gear unit are fixedly connected with respect to each other. Lateral position of the gun barrel cannot be changed quickly for special purposes.

PURPOSE OF THE INVENTION

The primary object of the invention is to provide a mounting assembly for a saddle frame structure having a cradle means for a gun barrel wherein the lateral adjustment of the projector or launcher tube can be changed quickly in a very simple manner.

Another object of the invention is to provide a mounting assembly for the cradle of a projector tube wherein gear members may be separated quickly from each other through actuation of a coupling mechanism.

A further object of the invention is to provide a mounting assembly for a saddle frame structure having a cradle means for a gun barrel wherein the gear driving unit may be functionally disengaged quickly and simply so that a rotatable bottom plate carrying the saddle frame structure may be freely rotatable with respect to a stationary base plate.

A still further object of this invention is to provide a mounting assembly wherein transverse adjustment of the projector or launcher tube of a fire arm is possible in a very short time and in a sudden manner to adapt quickly to a new shooting situation.

Another object of the invention is to provide the means for quick disengagement of a gear drive unit to change the lateral position of a gun barrel quickly and simply and for reengagement thereof after quick lateral adjustment to effectuate a fine tuning adjustment thereof.

SUMMARY OF THE INVENTION

The mounting assembly of this invention comprises bottom plate means pivotally mounted to stationary base plate means and carrying the saddle frame structure having a cradle means for a gun barrel. Drivable gear means pivotally rotates the bottom plate means with respect to the stationary base plate means.

Coupling means include means for engaging the drivable gear means to the stationary base plate means and adjusting means for moving the engaging means between a disengaged position and an engaged position. In the engaged position, the gear means engages the stationary base plate means for rotation of the base plate. In the disengaged position, the bottom plate means is free to rotate with respect to the stationary base plate means.

A feature of the invention is directed to a drivable gear means including a drivable worm gear unit and a toothed gear wheel which drivingly engages the stationary base plate means to rotate the bottom plate means carrying the saddle frame structure. The coupling engaging means is moved between the engaged and disengaged positions via the adjusting means which interrupts the connection of the drivable gear means to the stationary base plate means.

A particular feature of the drivable gear means includes a rotatably mounted gear shaft having a first gear member fixedly secured to one end thereof and a second gear member loosely mounted to the other end thereof to rotate freely about the gear shaft. The coupling engaging means is connected to rotate with the gear shaft and is movable between the engaged and disengaged positions. In the engaged position, the second gear member rotates the bottom plate means and in the disengaged position, the second member freely rotates while making the lateral adjustment of the projector tube.

In another feature of the invention, the engaging means includes a coupling sleeve member axially displaceable on the gear shaft between the engaged and disengaged positions. The second gear member includes second gear member drive means and primary gear teeth which engage a stationary gear track located on the stationary base plate means. In the engaged position, the coupling sleeve member contacts the second gear member drive means to rotate the second gear member. The coupling sleeve member is mounted to longitudinal spline or key members disposed in parallel along the outer surface of the gear shaft to secure the coupling sleeve member against rotation. At the same time, spline or key members allow axial displacement.

The adjusting means change position of the coupling sleeve member along the outer surface of the gear shaft. The disengagement of the coupling sleeve member can take place instantaneously. Thereupon, the saddle frame structure along with the cradle and projector tube are completely free to rotate within a large angular range.

According to a further feature of the invention, the adjustment actuating device includes a pivotally mounted angle lever. The outer free end of the angle lever is connected to a draw-bar member upon which there is a spring action. A manually operated hand lever is used to displace the draw-bar member along its longitudinal axis.

In a specific embodiment, the hand lever includes an eccentrically mounted end portion having a camming surface which slidingly engages an abutment means to move the draw-bar back and forth along its longitudinal axis. The inner end of the draw-bar connects to the outer, free end of the angle lever to pivot the angle lever. The other end of the angle lever is attached to the coupling sleeve member. Upon actuation of the eccentric, hand lever, disengagement of the coupling sleeve is carried out easily, quickly and in a simple manner.

In another feature of the invention, the drivable gear means includes a worm gear which may be motor driven. However, the worm gear may also be hand driven using a shaft journal connected to a hand actuating device such as a hand wheel. A guide rod and interposed universal joints connects the hand actuating device to the shaft journal. The hand wheel is rotatably secured to the saddle frame structure.

Another feature of the invention includes gear member drive means having drive gear teeth. The coupling sleeve member includes driving gear teeth engageable with the drive gear teeth to rotate the gear member. The stationary base plate means includes an upper annular ring member and a lower annular ring member defining bearing pocket means therebetween. Bearing means are disposed within the bearing pocket means and the bottom plate means includes a rotary ring mounted to rotate on the bearing means in the bearing pocket means. The gear member has teeth which contact a gear track on the stationary base plate means.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
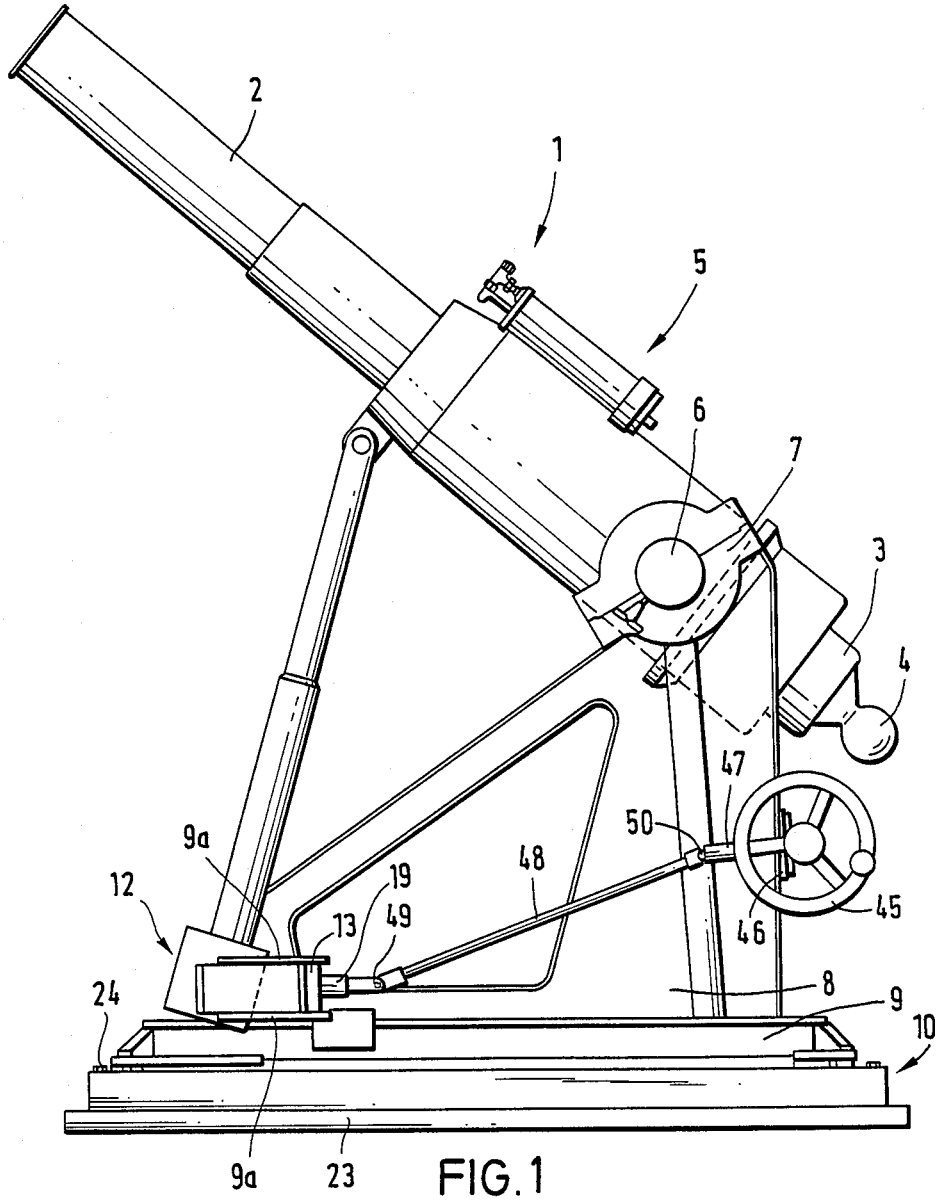
FIG. 1 is a side elevational view showing a launcher tube of a grenade projector with the projector tube mounted in a cradle of a rotatable saddle mounting assembly according to the invention.
Figure 2:
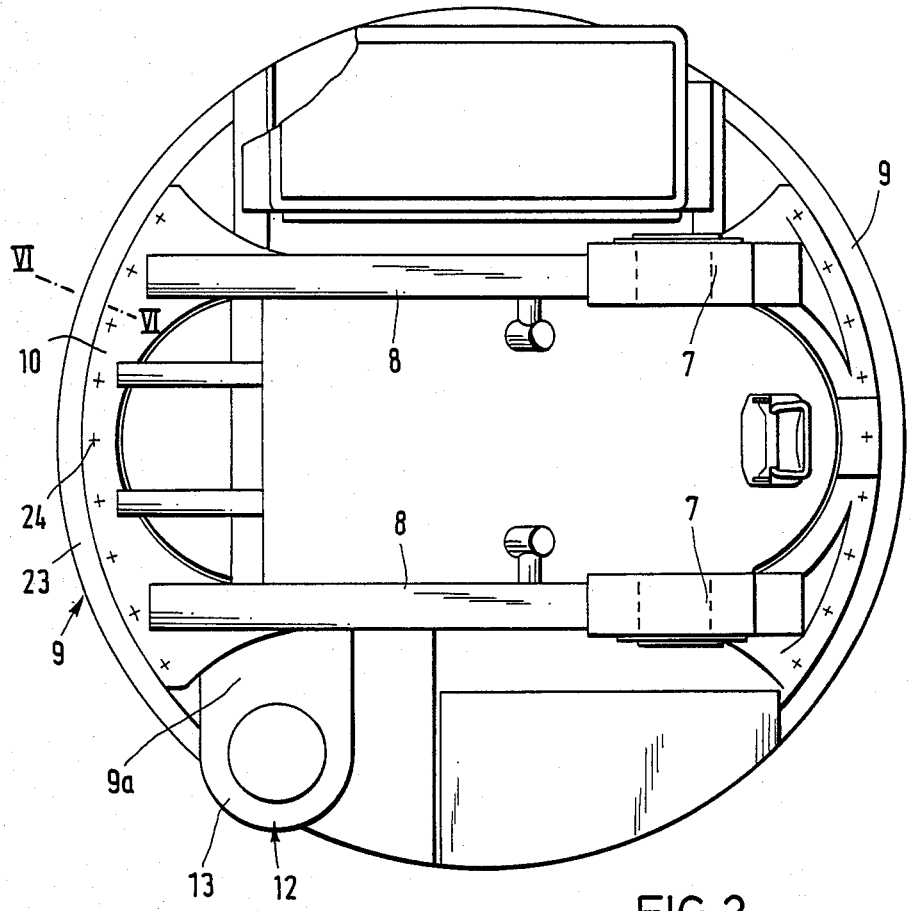
FIG. 2 is a diagrammatic top view of the saddle mounting assembly according to the invention without cradle and projector tube.

A grenade projector, generally designated 1, comprises a launcher tube 2 is coupled with a recoiled braking device, generally designated 5, and has a closed sealing cap 3 with a bottom piece 4 at its lower end. The bottom piece 4 is for articulated engagement with a base plate arranged in a well known manner on a support surface such as the ground or the like.

Projector or launcher tube 2 has a cross-journal 6 swivel-mounted in a cradle 7 supported by a saddle frame structure including saddle frame 8 and bottom plate 9 fixedly attached thereto. The frame structure is pivotally mounted to rotate with respect to base plate 10 fixedly arranged on a support surface and serving as a stationary bearing support.

Figure 3:
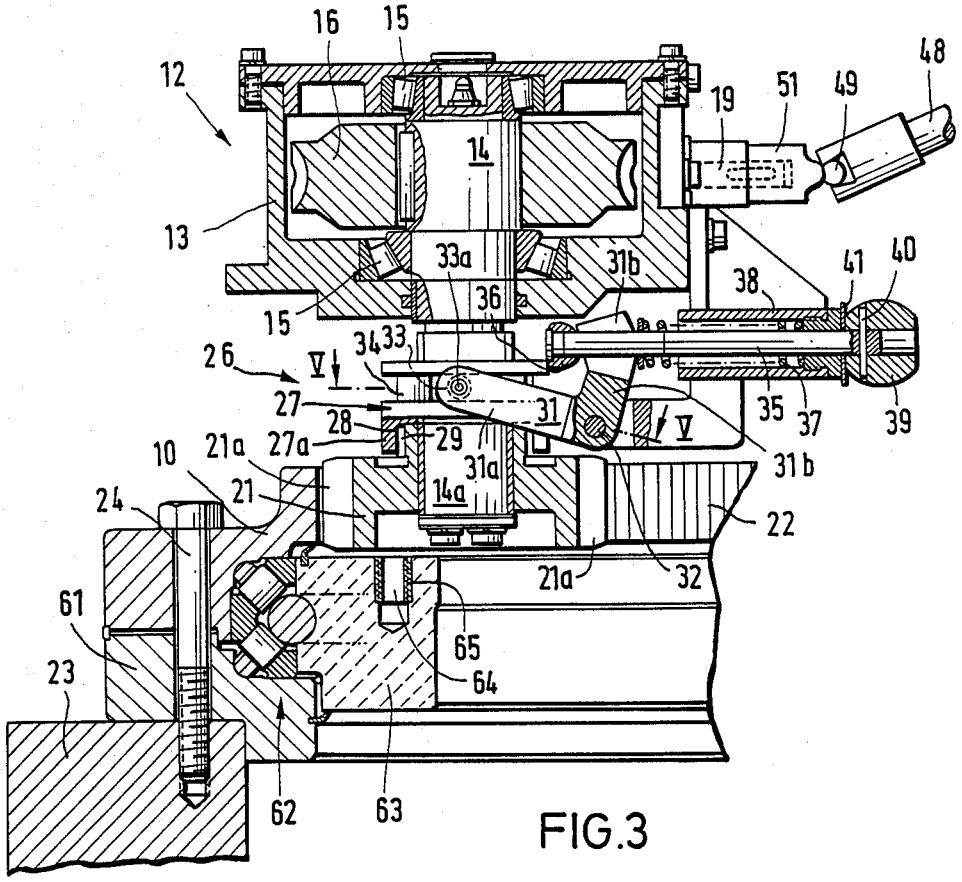
FIG. 3 is a fragmentary sectional view through the gear unit of the saddle mounting assembly in accordance with the invention.

Gear unit 12 is used to rotate the saddle frame structure 8 and 9 with respect to stationary bearing or base plate 10. As shown in FIG. 3, shaft 14 is rotatably mounted in bearings 15 and fixedly secured to worm gear wheel 16 so that rotation of gear wheel 16 rotates shaft 14. Saddle part 9a connects housing 13 to saddle bottom plate 9.

Worm gear 17 is mounted at one side of gear unit 12 in bearings 18 and threadingly engages worm gear wheel 16. A free-standing shaft journal 19 is fixedly secured to worm gear 17 for rotation by motor or by hand. In this specific embodiment, hand wheel 45 connects to journal 19 via rod 48 with universal joints 49 and 50.

A toothed wheel 21 is loosely mounted to freely rotate on lower end **14*a* of shaft 14 and includes a toothed rim 21*a* with primary gear teeth which grip the gear teeth of an annular inner toothed rim or gear track 22 of stationary bearing or base plate 10. Screws 24 fixedly connect plate 10 to stationary framework 23. Stationary framework 23** may be the substructure of a vehicle construction.

A coupling mechanism, generally designated 26, is disposed between shaft 14 and toothed wheel or gear member 21 to interrupt connection between worm gear wheel 16 and toothed gear wheel 21. Coupling 26 includes a coupling sleeve 27 mounted for displacement in an axial direction and connected to lower shaft portion **14*a* so that it is secure against rotation. Longitudinal splines or keys 14*b* on the outer surface of inner end 14*a* allow longitudinal, axial shifting of coupling sleeve 27 between an engaged position and a disengaged position with respect to loosely mounted gear wheel member 21**.

A ring flange **27*a* is mounted at the bottom of coupling sleeve 27 and includes an inner toothing 28 which engages an outer toothing 29, constituting gear member drive means for gear wheel 21 when the coupling sleeve 27 is in an engaged position as shown in FIG. 3. Angle lever 31 is pivotally mounted on a fixedly mounted axle 32. Long arm sections 31*a* rotatably support shafts 33*a* which carry rollers 33 disposed in a groove formed between upper and lower flanges 34 of coupling sleeve 27. Short leg 31*b* of angle lever 31 is bifurcated having a forked end structure disposed around draw-bar 35**.

The inner end of draw-bar 35 carries disk 36 which rests against fork 31b. In this embodiment, disk 36 is in the general shape of a sphere. A spring 37 mounted in stationary casing 38 acts against the other side of fork **31*b* as shown. Handle 39 is an eccentric lever pivotally mounted around eccentrically disposed pin 40 at the outer end of draw-bar 35**.

Figure 4:
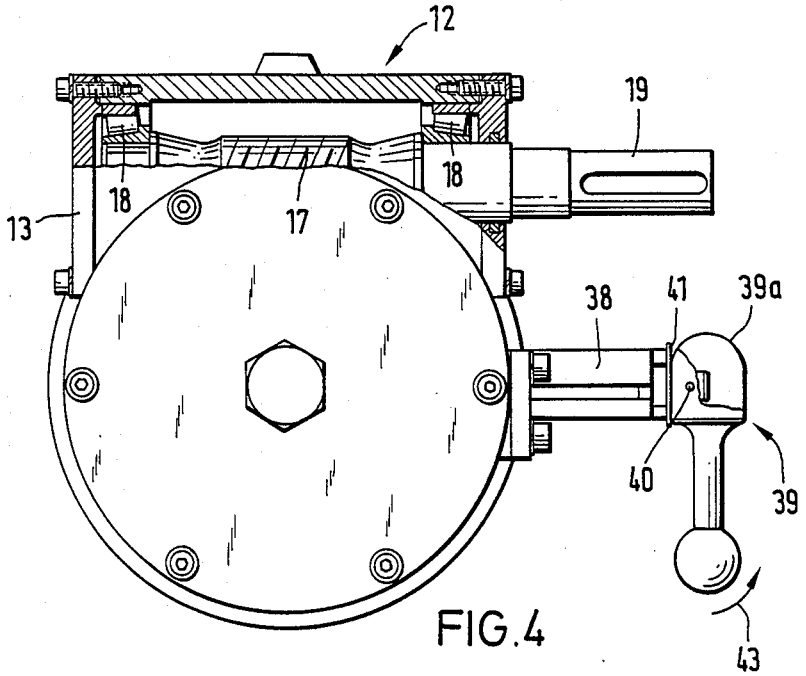
FIG. 4 is a diagrammatic top view of the housing for the gear unit of FIG. 3.
Figure 5:
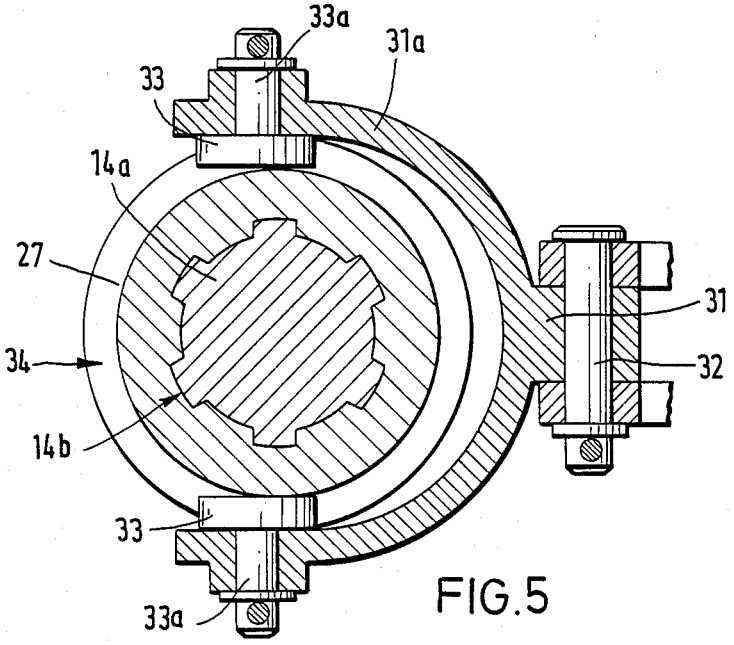
FIG. 5 is a sectional view along line V—V of FIG. 3.

As best seen in FIG. 4, camming surface **39*a* of hand lever 39 has a flat portion configuously supported against abutment plate 41 necessarily locking in the engaged position as shown. When lever 39 is turned in the direction of arrow 43 as shown in FIG. 4, draw-bar 35 is drawn outwardly against the action of spring 37 due to the eccentricity of bearing pin 40 thereby inherently mechanically fixing the longitudinal position of draw-bar 35. Consequently, angle lever 31 rotates in a clockwise direction thereby displacing coupling sleeve 27 upwardly in an axial direction to a mechanically fixed or secured disengaged position where the inwardly directed teeth 28 disengage from the outwardly directed drive teeth 29**.

With coupling sleeve 27 in a secured engaged position, saddle frame 8 with bottom plate 9 is no longer connected to rotate with toothed wheel 21. That is, saddle frame 8 is freely rotatable with projector tube 2 with respect to the stationary bearing or base plate 10. Such free rotational condition allows for the rotation of the projector tube 1 in an easy and quick manner.

When coupling mechanism 26 is in a locked in engaged position as shown in FIG. 4, the rotation of the projector tube 2 and the mounting support frame may be effected by rotating worm 17. Shaft journal 19 is connected to a casing 51 forming part of the universal joint 49 at the end of guide rod 48. A further universal joint 50 pivotally connects the other end of guide rod 48 to a shaft end 47 rotatably mounted in housing 46. Shaft end 47 is connected to the axle of hand wheel 45 via bevel wheels (not shown) in a well known manner.

When hand wheel 45 is rotated, worm gear 17 rotates through the connecting lengths of shaft end 47, rod 48, universal joints 49 and 50 and shaft journal 19 with casing 51. When worm gear wheel 17 rotates with coupling sleeve 27 in a lower, engaged position, toothed gear wheel 27 rotates rotary ring 63 via gear track 22 and gear teeth 21*a*. Thus, the saddle frame structure including saddle 8 and bottom plate 9 rotate with respect to the stationary bearing plate 10 and carry with it the cradle 7 and projector tube 2.

As noted, when coupling mechanism 26 is in a disengaged position, the saddle frame structure 8 and 9 may be freely turned either clockwise or counter-clockwise quickly and with very slight play. Housing 13 of gear unit 12 is an attachment to the saddle frame section 8.

The outer peripheral structure of the stationary bearing plate 10 includes an annular intermediate piece 61 held in place by screws 24 between the base plate 10 and stationary framework 23. The two annular parts enclose a bearing construction 62, in a bearing pocket defined between plate 10 and piece 61. Rotary ring 63 is rotatable mounted on the bearing construction.

Rotary ring 63 constitutes the bearing upon which the saddle frame member 8 and plate 9 support cradle 7 and tube 2. Screw bolts 64 engage threaded sockets 65 located in rotary ring 63. Thus, saddle bottom plate 9 with saddle part 9 is fixedly connected to rotary ring 63 so that saddle bottom plate 9 and saddle part 9*a* can be turned together with gear unit 12 and coupling mechanism 26 inside base plate parts 10 and 61 as shown.

Figure 6:
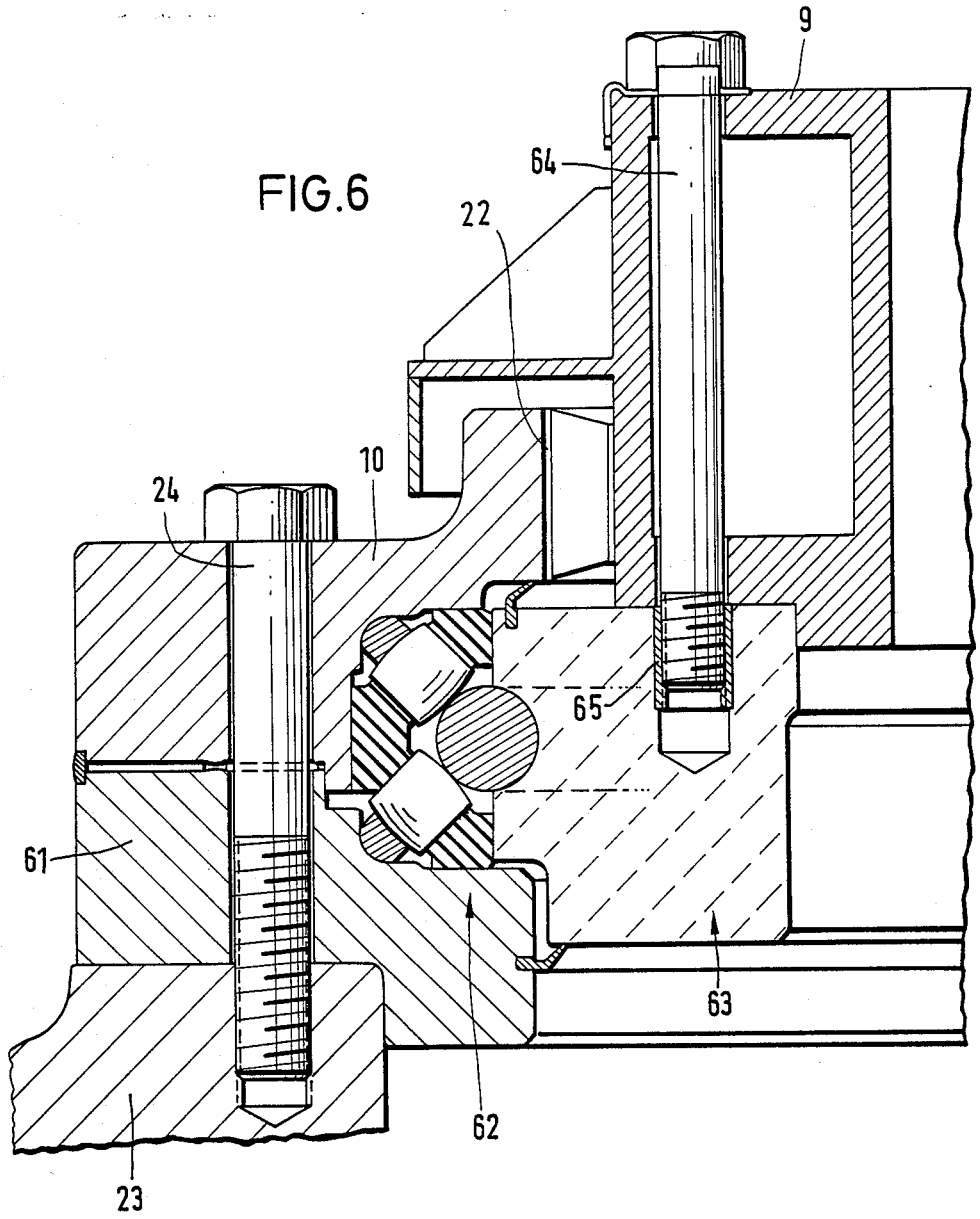
FIG. 6 is a fragmentary, enlarged sectional view along the line VI—VI of FIG. 2.

An outer, peripheral flange structure on plate 9 overchanges the upper edge portion of base plate part 10 including the gear track 22 as shown in FIG. 6.

While the mounting assembly for a saddle frame structure having a cradle for a gun barrel has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A mounting assembly for a saddle frame structure having cradle means for a gun barrel, said assembly comprising:

(a) bottom plate means pivotally mounted to stationary base plate means and carrying the saddle frame structure, (b) drivable gear means for pivotally rotating the bottom plate means with respect to the base plate means, and (c) coupling means including means for engaging the drivable gear means to the stationary base plate means, (d) said coupling means including adjusting means for moving the engaging means between a disengaged position and an engaged position in which drivable gear means is effective to rotate the bottom plate means, (e) the drivable gear means including a rotatably mounted gear shaft having a first gear member fixedly secured to one end thereof and a second gear member loosely mounted at the other end thereof to rotate loosely about the gear shaft, (f) said coupling engaging means including a coupling sleeve member axially displaceable on the gear shaft between the engaged and disengaged positions, (g) said adjusting means being connected to the coupling sleeve member to effect said axial displacement of the sleeve member, (h) the adjusting means including a pivotally mounted angle lever means having one end cooperating with the coupling sleeve member and the other end thereof connected to lever displacement means for pivotally moving the angle lever means, (i) the lever displacement means including a draw-bar member movably displaceable against spring action, (j) the draw-bar member is elongate, has a longitudinal axis and is mounted for movement along its (k) one end of the draw-bar member is connected to said other end of the angle lever means and an opposite end of the draw-bar member is connected to manually operable, draw-bar displacing means, (l) the draw-bar displacing means includes abutment means and a hand lever member, (m) said hand lever having a camming surface eccentrically mounted to said opposite end of the draw-bar member, (n) the camming surface being in sliding contact with the abutment means to effect movement of the elongate draw-bar member along its longitudinal axis when the draw-bar displacing means is operated.

2. An assembly as defined in claim 1 wherein the drivable gear means is fixedly mounted to the bottom plate means and includes worm gear means and a rotatably mounted gear shaft having a first gear member fixedly secured to one end thereof and a second gear member loosely mounted at the other end thereof to rotate freely about the gear shaft, said worm gear means being engaged with the first gear member for rotating the gear shaft upon rotation of the worm gear means.

3. An assembly as defined in claim 2 wherein the worm gear means includes a worm gear member having a shaft journal drivingly connected to a hand wheel via a guide rod member having universal joint connections at each end thereof, said hand wheel being rotatably mounted to the saddle frame structure.

4. An assembly as defined in claim 1 wherein the stationary base plate means includes an upper annular ring member and a lower annular ring member defining bearing pocket means therebetween with bearing means disposed within said bearing pocket means, and the bottom plate means includes a rotary ring mounted to rotate on the bearing means in said bearing pocket means.

5. An assembly as defined in claim 4 wherein said drivable gear means is fixedly mounted to rotate with said rotary ring.

6. A mounting assembly for a saddle frame structure having cradle means for a gun barrel, said assembly comprising:

(a) bottom plate means mounted to freely rotate with respect to stationary base plate means and carrying the saddle frame structure, (b) drivable gear means for drivingly rotating the bottom plate means with respect to the stationary base plate means when the drivable gear means is operatively engaged to rotate the bottom plate means, (c) engaging means for operatively engaging the drivable gear means to rotate the bottom plate means with respect to the stationary base plate means, and (d) actuating means for moving the engaging means between a disengaged position in which the drivable gear means is not operatively engaged so that the bottom plate means is in a freely rotatable condition and an engaged position in which the drivable gear means is effective to rotate the bottom plate means, (e) said actuating means including abutment means and a hand lever member for quickly effecting complete release of the drivable gear means by quickly moving the engaging means to said disengaged position, (f) said hand lever member having a camming surface eccentrically mounted with respect to an axis of rotation for the hand lever member and being in sliding contact with the abutment means to effect a complete release of the drivable gear means.

7. An assembly as defined in claim 6 wherein the drivable gear means includes a rotatably mounted gear shaft having a first gear member fixedly secured to one end thereof and a second gear member loosely mounted at the other end thereof to rotate loosely about the gear shaft, said engaging means includes a coupling sleeve member axially displaceable on the gear shaft between the engaged and disengaged positions, said actuating means being connected to the coupling sleeve member to effect said axial displacement of the sleeve member.

8. An assembly as defined in claim 7 wherein the actuating means includes a pivotally mounted angle lever means having one end cooperating with the coupling sleeve member and the other end thereof connected to lever displacement means for pivotally moving the angle lever means.

9. An assembly as defined in claim 8 wherein the lever displacement means includes a draw-bar member movably displaceable by the hand lever member against spring action.

10. An assembly as defined in claim 8 wherein the drivable gear means is fixedly mounted to the bottom plate means and includes worm gear means, said worm gear means being engaged with the first gear member for rotating the gear shaft upon rotation of the worm gear means, the worm gear means includes a worm gear member having a shaft journal drivingly connected to a hand wheel via a guide rod member having universal joint connections at each end thereof.

11. An assembly as defined in claim 10 wherein the stationary base plate means includes an upper annular ring member and a low annular ring member defining bearing pocket means therebetween with bearing means disposed within said bearing pocket means, and the bottom plate means includes a rotary ring mounted to rotate on the bearing means in said bearing pocket means.

* * * * *